United States Patent [19]

Pfister

[11] 4,362,110

[45] Dec. 7, 1982

[54] INTERCONNECTED RAILWAY VEHICLE TRUCKS

[75] Inventor: Johann K. Pfister, Dietlikon, Switzerland

[73] Assignee: Schweizerische Lokomotiv-und Maschinenfabrik, Winterthur, Switzerland

[21] Appl. No.: 166,097

[22] Filed: Jul. 7, 1980

[30] Foreign Application Priority Data

Jul. 6, 1979 [CH] Switzerland ..... 6344/79

[51] Int. Cl.[3] ..... B61F 3/08; B61F 5/02; B61F 5/38; B61F 5/52

[52] U.S. Cl. ..... 105/176; 105/167; 105/171; 105/199 R

[58] Field of Search ..... 105/165, 166, 167, 168, 105/176, 197 R, 169, 170, 171, 199 R

[56] References Cited

U.S. PATENT DOCUMENTS

| | | | |
|---|---|---|---|
| 1,728,096 | 9/1929 | Algrain | 105/168 X |
| 3,614,931 | 10/1971 | Adler | 105/199 A |
| 3,961,583 | 6/1976 | Fagel | 105/168 X |
| 4,273,348 | 6/1981 | Middeldorf | 105/176 X |

FOREIGN PATENT DOCUMENTS

| | | | |
|---|---|---|---|
| 955242 | 1/1957 | Fed. Rep. of Germany | 105/176 |
| 304933 | 4/1955 | Switzerland | 105/176 |
| 614892 | 12/1979 | Switzerland | 105/176 |

OTHER PUBLICATIONS

Houdaille Industries by Auto-Teile-Präzision K.G. Frankfurt/Main, West-Germany, Friction Snubbers VA-No. 1199, 3 pp.

Boge Zweirohr-Dämpfer, Boge Stossdamper, GmbH, D5028, Eitorf (Sieg) Deutschland, pp. 18 & 19.

*Primary Examiner*—Robert B. Reeves
*Assistant Examiner*—Howard Beltran
*Attorney, Agent, or Firm*—Kenyon & Kenyon

[57] ABSTRACT

The cross-coupling connects the two trucks of the vehicle together and employs a torsion shaft which is mounted on the vehicle body with torsionally stiff levers. The cross-coupling also has a shaft mounted on each truck with a pair of torsionally stiff arms. The innermost arms of the shafts are articulated via a hinged rod to an associated lever of the torsion shaft while the outermost arms are articulated through a rod to the vehicle body. In addition, piston cylinder units are provided for damping the rotational movements of the trucks relative to the body as well as independent damping means for damping the transverse movements of the vehicle body relative to the trucks.

8 Claims, 2 Drawing Figures

INTERCONNECTED RAILWAY VEHICLE TRUCKS

Figure 1:
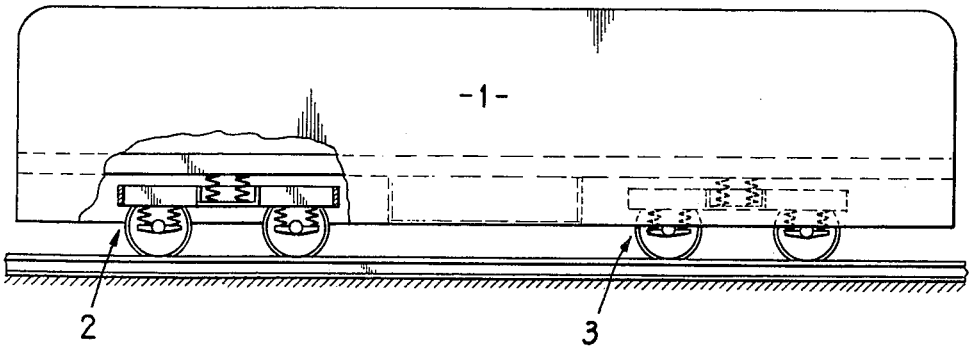

This invention relates to a rail vehicle having a cross-coupling.

Heretofore, it has been known to support a rail body of a rail vehicle on pairs of trucks and to couple the mutually facing ends of the trucks via a cross-coupling in such a way that horizontal forces can be transmitted from one truck to the other. This allows a reduction of the forces between the flanges on the wheels of a truck and the rails on which the trucks ride and which, during travel through a curve, act on the wheel sets of the trucks. A reduction in the sliding friction is also obtained along with a reduction in wear of the flanges and rails.

For example, as described in Swiss Pat. No. 304,933, a direct cross-coupling is used as a drawbar coupling wherein threepoint links (drawbars) are articulated at the mutually facing ends of two trucks and are connected together through a joint connection. Such a drawbar coupling satisfactorily fulfills a cross-coupling function and offers the advantage that for a rigid coupling connection without play, no "error" occurs in the relative positions of the trucks in track curves. That is, in track curves, the longitudinally extending vertical median planes of the two trucks intersect in a vertical line which is located in a likewise vertical plane extending normal to the main axis of the vehicle box in the center between the trucks. This construction, however, takes up so much space between the trucks that it is impossible to place other equipment, such as a transformer of an electric locomotive or a fuel tank of a diesel locomotive, between the trucks and thus keep the center of gravity of the entire vehicle low.

Another cross-coupling with shortened drawbars is described in Swiss Pat. No. 614,892 and DT-OS No. 27 09 967 wherein drawbacks act through rods and lever arms on a torsion shaft mounted in the longitudinal direction on a vehicle body. While the space between the trucks is kept free in this construction, the desired cross-coupling effect can be achieved only by means of fixed trunnions between the vehicle body and the trucks, as otherwise a displacement of the vehicle body in a transverse direction of the trucks would result in an error in the relative positions of the trucks in track curves. An error can also occur when a transverse spring support instead of a fixed trunnion is used. In modern locomotives this is frequently the case, due to the speeds in curves common today. This type of transverse spring support effects the magnitude of the error and, thus, limits the use of the support.

Accordingly, it is an object of the invention to provide a rail vehicle of the above mentioned kind wherein the space between the trucks is not obstructed by a cross-coupling but is free for the installation of structural parts.

It is another object of the invention to a rail vehicle wherein the transverse spring support of the trucks is freely selectable.

Briefly, the invention provides a rail vehicle which is constructed with a vehicle body, a pair of trucks supporting the body and a cross-coupling connecting the trucks together. In accordance with the invention, the cross-coupling includes a torsion shaft mounted on the body and extending longitudinally of the body and a pair of torsionally stiff levers each of which is disposed at a respective end of the torsion shaft. In addition, a shaft is mounted on each respective truck in parallel to the torsion shaft along with a pair of torsionally stiff arms each disposed on a respective end of a shaft. Also, a rod is hinged to and between an innermost arm on each truck and a respective one of the levers on the torsion shaft. In a similar manner, a rod is articulated between and to an outermost arm on each truck and the vehicle body.

The construction has the advantage that with the relatively low cost of two additional shafts mounted on the trucks, the transverse spring suspension of the trucks is freely selectable. Further, while providing a properly functioning cross-coupling, the space between the trucks can be utilized for the installation of a transformer or a diesel fuel tank. Hence, the center of gravity of the entire vehicle can be kept lower.

The innermost arms of the shafts mounted on the trucks may have a lever length which equals the lever length of the outermost arms. Thus, independence of the transverse movements of the trucks on straight tracks can be achieved, although slight errors in the operation of the cross-coupling may be inevitable.

By fulfillment of the equation $A/B=m/(m+2n)$ between the lever lengths A, B of the arms of the shaft on the trucks, length m of the torsion shaft, and the length n of the shafts mounted on the trucks, conditions can be created which are equal to those in drawbar couplings, i.e. optimum cross-coupling effects (absence of error) in curves, but with a slight coupling effect between the transverse movements of the two trucks in straight sections.

According to a further development of the invention, the cross-coupling has at least one means for damping the rotational movements of the two trucks relative to the body, and at least one means for damping the transverse movement of the trucks relative to the vehicle body substantially independent of the damping means for rotational movements. These means may have different damping characteristics, so that the two movements can be damped entirely independently of each other.

Figure 2:
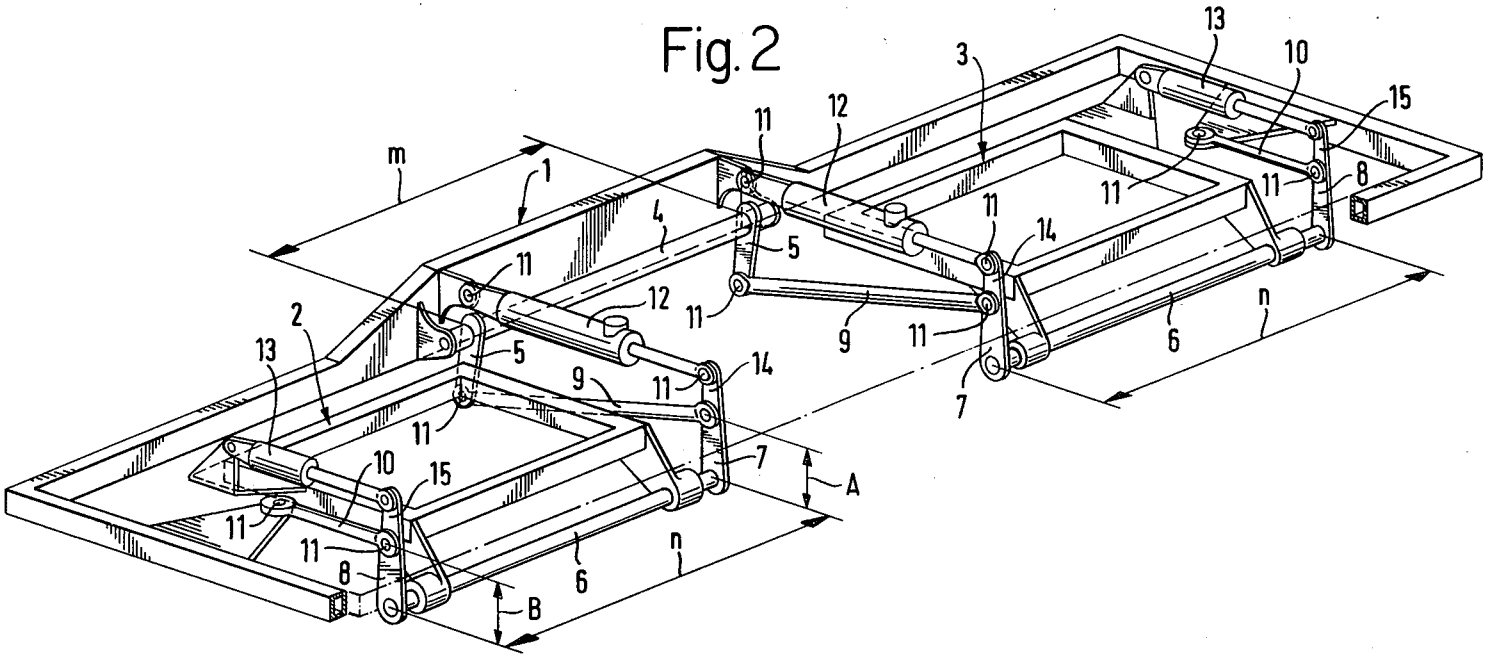

These and other objects and advantages of the invention will become more apparent from the following detailed description taken in conjunction with the accompanying drawings in which:

FIG. 1 illustrates a partial broken view of a rail vehicle constructed in accordance with the invention; and FIG. 2 shows parts of a rail vehicle according to the invention in schematic axonometric representation.

Referring to FIG. 1, the rail vehicle includes a frame of a vehicle body 1 and a pair of trucks 2, 3 supporting the body 1 thereon via supporting springs. In addition, as shown in FIG. 2 the vehicle has a cross-coupling connecting the trucks 2, 3 together. This cross-coupling includes a torsion shaft 4 mounted on the body 1 which extends longitudinally of the body 1. In addition, a pair of torsionally stiff levers 5 are disposed at the respective ends of the torsion shaft 4 and extend in a downwardly directed direction.

The cross-coupling also has a pair of shafts 6, each of which is mounted on a respective truck 2, 3 in parallel with the torsion shaft 4. As indicated, the shafts 6 are disposed on a side of a truck 2, 3 away from the torsion shaft 4. Each of these shafts 6 are torsion shafts and extend in the longitudinal direction of the vehicle body 1. In addition, each shaft 6 has a pair of torsionally stiff arms 7, 8 disposed at the respective ends. As indicated, each of these arms 7, 8 are directed upwardly.

The innermost arms 7 on the respective shafts 6, i.e. the arms adjacent the center of the vehicle are each hinged to a rod 9 via a ball and socket joint 11. Each rod 9 is also hinged by a ball and socket joint 11 to a lever 5 of the torsion shaft 4 which is aligned with the arm 7. The outermost arms 8, i.e. the arms remote from the vehicle center, are each hinged via a ball and socket joint 11 to a rod 10 which, in turn, is hinged via a ball and socket joint 11 to the vehicle body 1. As shown, a bracket is provided on the longitudinal axis of the vehicle body for connection of a respective rod 10.

As shown, the respective arms 7, 8 have a lever length A, B of predetermined dimension. In addition, each shaft 6 is of a determinate length n between the arms 7, 8 while the torsion shaft 4 is of determinate length m between the levers 5.

During operation, if the rail vehicle transverse a track curve, for example with the truck 3 being rotated relative to the vehicle body, a cross-coupling force is transmitted to the truck 2 via the rods 9 and torsion shaft 4. This cross-coupling force has reactions which are developed against the vehicle body 1 over the rods 10. As a result, there is a reduction in the forces occurring between the flange (i.e. the flanges of the wheels mounted in the trucks 2, 3) and rail (i.e. the rails on which the vehicle trucks ride).

If the determining lengths A and B of the lever arms 7, 8 are taken equal, i.e. $A=B$, a torque about a vertical axis is transmitted from one truck to the other by the cross-coupling linkage in traveling through a curve. Vehicle body 1 then experiences a reaction of double the amount of the transmitted torque. This reaction is finally absorbed by the body support. Equal lever lengths have the advantage that the individual transverse movements of the trucks do not influence each other and only the pure rotational movements of the two trucks are coupled together. This is advantageous in straight-line running.

According to another embodiment, conditions are created such that the equation $A/B=m/(m+2n)$ between the lever lengths A, B and the lengths m and n of the shafts 4 and 6 is fulfilled. In this case, the cross-coupling has, with respect to the position of the trucks in a track curve, exactly the same effect as a drawbar coupling. That is, the forces transmitted through the coupling rods between the trucks and the vehicle body are reduced to a single force, which is transmitted from one truck to the other in the center of the vehicle. The body then remains free of any reaction. This has a favorable effect on running in curves.

Each of the trucks 2, 3 is also provided with a damping device or means 12 in the plane of the hinged rod 9 and a damping device or means 13 in the plane of the rod 10. Each damping device or means 12, e.g. a hydraulic piston-cylinder unit, is articulated at the cylinder end to the torsion shaft side of vehicle body 1 above the torsion shaft 4, and at the piston rod end to an extension 14 of the arm 7 through a ball-and-socket joint 11. Each damping device or means 12 serves to damp rotational movements of the trucks 2, 3 relative to the vehicle body 1. Each damping device or means 13, likewise a hydraulic piston-cylinder unit which is independent of the damping means 12, is articulated at the cylinder end toward the torsion side of the vehicle body 1 to the truck 2, 3 and at the piston rod end to an extension 14 of an arm 8. Thus, the transverse movement of trucks 2, 3 relative to vehicle body 1 is damped. The damping characteristics of the rotation-damping device or means 12 may be different from the damping characteristics of the transverse movement damping device or means 13.

It is noted that other modifications in the cross-coupling are also possible. The lever arms 5, 7 for example need not be oppositely directed but may be codirectional. The damping device or means 12, 13 may be articulated at any desired points of the vehicle body or of the trucks. Anywhere in the linkage, elastic members of known kind may be installed. The two rotation-damping device or means 12 may be replaced by a single rotation-damping means disposed between the trucks, which act through both arms 7 simultaneously on both shafts 6. The damping device or means may be of a fluid type such as the hydraulic piston-cylinder unit described in U.S. Pat. No. 3,614,931. The damping device or means may also be e.g. friction damping devices such as described in the prospectus of Houdaille Industries entitled "Friction Snubbers", or they may be, in part, friction and, in part, fluid damping device or means.

The invention thus provides a cross-coupling for a pair of trucks of a vehicle body which provides a space between the trucks in which other equipment can be disposed. In this way, the center of gravity of the entire rail vehicle can be lowered.

The cross-coupling also allows the transverse spring support of the trucks to be freely selected instead of using a fixed trunnion.

The embodiments of the invention in which an inclusive property or priviledge is claimed are defined as follows:

1. A rail vehicle comprising
a vehicle body;
a pair of trucks rotationally and transversely supporting said body thereon; and
a cross-coupling connecting said trucks together, said cross-coupling including
a torsion bar mounted on said body and extending longitudinally of said vehicle body,
a pair of torsionally stiff levers, each said lever being disposed at a respective end of said torsion bar,
a pair of shafts, each said shaft being mounted on a respective truck in parallel to said torsion bar,
two pairs of torsionally stiff arms, each said pair of arms being disposed on the respective ends of each said shaft,
a first pair of rods, each said rod being hinged to and between an innermost arm of said pair of arms on a respective truck and one of said levers on said torsion bar, and
a second pair of rods, each said rod of said second pair of rods being articulated to and between an outermost arm of said pair of arms on a respective truck and said vehicle body.

2. A rail vehicle as set forth in claim 1 wherein said innermost arms and said outermost arms have an equal lever length.

3. A rail vehicle as set forth in claim 1 wherein said cross-coupling further includes at least one means for damping rotational movements of said trucks relative to said body and at least one means for damping transverse movements of said trucks relative to said body.

4. A rail vehicle as set forth in claim 3 wherein said cross-coupling includes a pair of said transverse damping means extending transversely of said body, each said transverse damping means being articulated to and between a respective truck and a respective outermost one of said arms.

5. A rail vehicle as set forth in claim 3 wherein at least one of said rotational damping means and said transverse damping means is a fluid damping means.

6. A rail vehicle as set forth in claim 3 wherein at least one of said rotational damping means and said transverse damping means is a friction damping means.

7. A rail vehicle as set forth in claim 3 wherein said cross-coupling includes a pair of said rotational damping means located between said trucks and extending transversely of said body, each said rotational damping means being articulated to and between said vehicle body and a respective innermost one of said arms.

8. A rail vehicle as set forth in claim 7 wherein said cross-coupling includes a pair of said transverse damping means extending transversely of said body, each said transverse damping means being articulated to and between a respective truck and a respective outermost one of said arms.

* * * * *